United States Patent [19]

Sugimura et al.

[11] 4,243,488

[45] Jan. 6, 1981

[54] COKE COMPOSITIONS AND PROCESS FOR MANUFACTURING SAME

[75] Inventors: Hidehiko Sugimura; Keichiro Koba, both of Tokyo, Japan

[73] Assignee: Mitsui Coke Co., Ltd., Tokyo, Japan

[21] Appl. No.: 925,327

[22] Filed: Jul. 17, 1978

Related U.S. Application Data

[63] Continuation of Ser. No. 670,959, Mar. 26, 1976, abandoned.

[30] Foreign Application Priority Data

May 21, 1975 [JP] Japan ..... 50/59767

[51] Int. Cl.[2] ..... C10B 53/04; C10B 53/08; C10G 1/04

[52] U.S. Cl. ..... 201/6; 201/21; 201/23; 208/8 LE

[58] Field of Search ..... 201/5, 6, 21–24; 44/1 R; 208/8, 45

[56] References Cited

U.S. PATENT DOCUMENTS

| | | | |
|---|---|---|---|
| 1,950,811 | 3/1934 | Pier et al. | 201/24 |
| 2,556,154 | 6/1951 | Kern | 201/24 X |
| 3,120,474 | 2/1964 | Gorin et al. | 201/24 X |
| 3,140,242 | 7/1964 | Work et al. | 201/5 |
| 3,240,566 | 3/1966 | Bullough et al. | 208/8 X |
| 3,562,783 | 2/1971 | Gorin | 201/6 |
| 3,700,583 | 10/1972 | Salamony et al. | 208/8 |
| 3,791,956 | 2/1974 | Gorin et al. | 208/8 |
| 3,892,654 | 7/1975 | Wright et al. | 208/8 |
| 3,954,595 | 5/1976 | Sze et al. | 208/8 |
| 3,997,422 | 12/1976 | Bull et al. | 208/8 |

*Primary Examiner*—Michael S. Marcus

*Attorney, Agent, or Firm*—Schwartz, Jeffery, Schwaab, Mack, Blumenthal & Koch

[57] ABSTRACT

Metallurgical coke is made from coking a blend of coal which is comprised of reformed coal and another suitable coking coal. Reformed coal hereof is preferably made by the method which comprises dissolving at least one component selected from the group consisting of bituminous coal, subbituminous coal, brown coal and lignite in a hydrocarbon solvent, and recovering a reformed coal from said solution.

15 Claims, 1 Drawing Figure

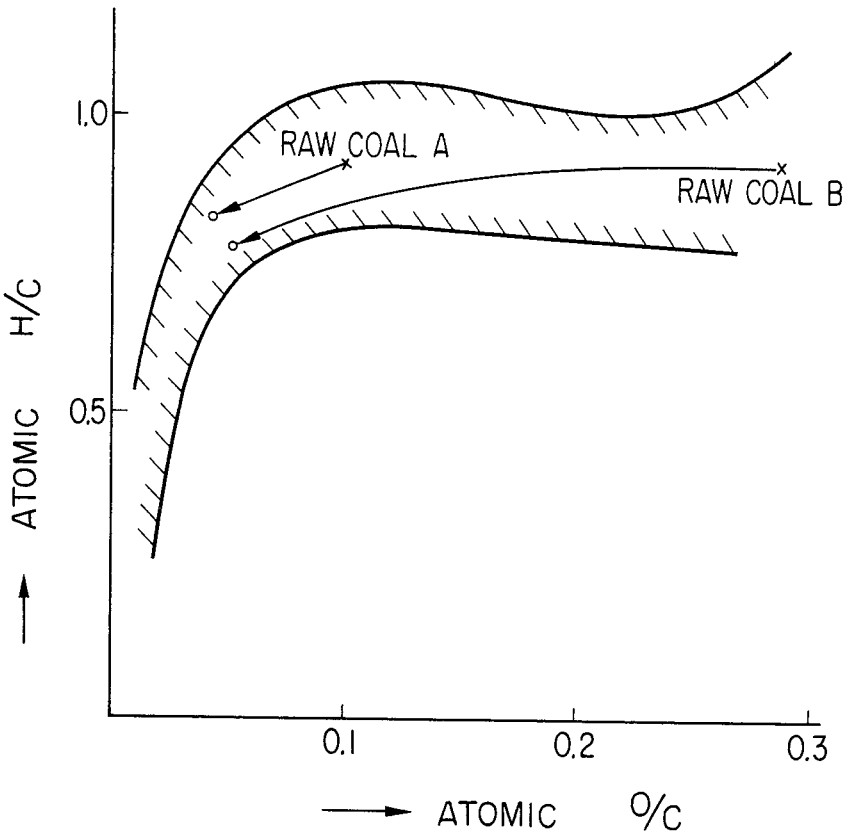
1.0
0.5
ATOMIC H/C
RAW COAL A
RAW COAL B
0.1
0.2
0.3
ATOMIC O/C

COKE COMPOSITIONS AND PROCESS FOR MANUFACTURING SAME

This is a continuation of application Ser. No. 670,959, filed Mar. 26, 1976 now abandoned.

BACKGROUND OF THE INVENTION

The present invention relates to the manufacture of reformed coal and of coke, and more especially to a process for manufacturing the coke with a higher strength and a lower impurity content using the reformed coal and to the products thereof.

It is well known that the properties of coke are determined by the properties of the particular types of coal employed and the ratio in which they are blended when producing coke in a conventional coke oven. In order to produce coke of excellent quality, therefore, the use of excellent coking coal is necessary. The large-sized blast furnaces which have been developed recently for increasing the yield of iron require a large amount of excellent quality coke and thus, there is a demand for a large amount of coal suitable for producing metallurgical coke, particularly for strongly-coking coal. However, many parts of the world are not possessed of an abundant quantity of such strongly-coking coal, and because of this and shipping costs, the price of that coal has become higher and higher. Accordingly, it has become difficult to maintain both the strength and the price of the coke at levels of the past.

In order to solve this problem, several investigations have been performed according to which lower-grade-coal is changed into higher-grade-coal, and in this manner the strength of coke is kept at previous levels. For example, the following processes have been investigated:

- a process of manufacturing formed-coke by hot briquetting;
- a process of feeding molding-coal into a chamber oven;
- a process of feeding dryed-coal into a chamber oven; and
- a process of manufacturing reformed coal by blending petroleum-pitch.

However, because all of the processes described above possess one or more unresolved technical and/or economical problems, the manufacturing industry has not yet adopted any of them, and therefore there has not been a sufficient reduction in the use of higher-grade-coking coal. Furthermore, since the sulphur content in the lower-grade-coal is not reduced in accordance with the proposed processes, the coke produced from coal produced thereby has inferior properties.

There is in the world a large amount of coal with higher strength as an aggregate and lower coking capacity. When a suitable binder is blended with coal of this type, excellent coke for iron manufacturing is produced. Accordingly, provision of a binder which has suitable coking properties is necessary from the standpoint of conserving natural resources and improving the economy.

Coal pitch, petroleum pitch, reformed asphalt or "Bojuntan" have previously been considered as binders. Desirable properties of a binder require that the binder melts at a temperature of between about 400° C.-500° C. to a plastified state and causes coal particles to adhere to each other. Also, because of the reasons set forth above, it is necessary that a binder has a structure similar to the coking component of coal, which is composed of condensed, aromatic ring structures. On the basis of these considerations, various manufacturing methods for the binder have been attempted to produce a substance for blending with raw coal, but such a product providing a sufficient effect has yet to be produced.

Generally, since coal mainly has the structure of condensed, aromatic ring structures, a satisfactory binder can be produced from coal by a method wherein side chains and functional groups in coal are reduced, the bonds between each aromatic rings are broken, and only the portion of condensed, aromatic substances is separated and extracted.

On the basis of these considerations, the method of "Bojuntan" was tried. But, by this method, since the coal is thermally treated only at normal pressures, the fundamental structure of the coal is not changed and the particles of coal are only swelled by the large quantity of solvent. For this reason, in order to produce an excellent binder by this method, careful selection of the coal is necessary. Furthermore, productivity is low and the sulphur content, which is harmful for coke, is not reduced by this method.

SUMMARY OF THE INVENTION

An object of this invention is to produce high grade coke for the iron manufacturing industry.

A further object of this invention is to supply such coke economically by the means of using a reformed, coal instead of a high grade coking coal.

Yet another object of the invention resides in providing an improved coke composition.

In accomplishing the foregoing and other objects, there has been provided in accordance with the present invention a process for manufacturing coke, comprising the steps of blending a reformed coal with at least one other coal which is suitable for carbonization; and subjecting the blended coal to coking conditions. Preferably, the coal which is reformed is selected from the group consisting of bituminous coal sub-bituminous coal brown coal and lignite.

In one preferred aspect of the invention, the process comprises the steps of (a) dissolving at least one component selected from the group consisting of bituminous coal, sub-bituminous coal, brown coal and lignite in a hydrocarbon solvent under hydrogenation conditions to produce a solution; (b) recovering a reformed coal from the solution; (c) blending the reformed coal with at least one other coal which is suitable for carbonization; and (d) subjecting the blended coal to coking conditions.

Other objects, features and advantages of the invention will become apparent from the following detailed description of preferred embodiments, when considered together with the attached sheet of drawing.

BRIEF DESCRIPTION OF THE DRAWING

The drawing is a coal band curve in which the ranks of coalification of the reformed coal (shown as o) and the raw coal (shown as x) are shown.

DETAILED DESCRIPTION OF PREFERRED EMBODIMENTS

In this invention, bituminous coal, sub-bituminous coal or a lower rank coal, such as brown coal, is thermally threated in a solvent under the pressure of hydrogen, whereupon reformed coal of high fluidity and low sulfur content is obtained from the dissolved matter in the solvent, and the reformed coal thus formed is blended with other types of coal as the binder in order to produce excellent, high strength coke.

The lower grade coal in this invention is the coal having no sufficient fluidity and high content of ash and sulphur. Since the coal used herein does not have sufficient fluidity, excellent coke was not produced from this coal in a conventional chamber oven. In addition, since the coal used herein has a large sulfur content, it has not heretofore been used to produce metallurgical coke.

According to this invention, when this lower grade coal is treated in a suitable solvent under the pressure of hydrogen, the coal is changed into reformed coal which can be blended with coal suitable for the production of metallugical coke, which coal is characterized by a high fluidity, a lower sulfur content and normal ash content.

The blended coal itself may be coked in a conventional oven just as it is, or after biquetting same or after briquetting same followed by blending with another suitable coal. The coke produced is an excellent coke for metallugical purposes.

Coal crushed to a suitable particle size is slurried in a hydrocarbon solvent, for example, coal-oil petroleum oil or the distillating fraction having the boiling point of higher than 150° C. produced in this reaction system by the decomposition of coal or the mixing oil thereof. The ratio of coal to solvent (be weight) is from about 1:1 to 1:6, preferably from about 1:1.2 to 1:3.

The slurry is dissolved at a temperature of about 300° C.–500° C., and the partial pressure of hydrogen is greater than about 3 kg/cm$^2$, preferably from about 50 kg/cm$^2$–200 kg/cm$^2$. The insoluble component naturally changes into the soluble component by the hydrogenolysis and depolymerization of coal, and the organic sulfur in coal changes to $H_2S$. Thus, the process is effective to remove sulfur from the reformed coal.

More particularly, for the liquification of coal by hydrogenolytic decomposition, a hydrocarbon solvent is used. Coal is dispersed into the hydrocarbon solvent and the resulting slurry is introduced into a reactor.

In the reactor, the slurry is liquified by depolymerization of the coal, and this is accelerated by a higher temperature and a higher pressure of hydrogen. In one case, any undissolved solids in the solvent are separated by the application of filtration, the filtrate is then distilled and a reformed coal of high grade is obtained.

In the other case, any undissolved solid in the solvent are not separated, the solvent is then distilled as it is and a reformed coal of high grade is obtained.

Coal described above represents bituminous coal, sub-bituminous coal, brown coal, or lignite. The hydrocarbon solvent represents the oil having a boiling point of higher than 150° C.

Coal in this invention is used in the form of comminuted particles preferably of a size less than about 28 mesh or crushed particles, preferably of a size between about 2 mm and 100 mm size. In the case of using comminuted particles, coal is dispersed easily in the solvent, and the reaction rate of hydrogenolytic decomposition is higher. On the other hand, in the case of using crushed particles, it is not necessary to employ any special and expensive comminution apparatus, and in addition, separation of solids from the solvent is made easier. The coal is added to the solvent in a ratio of about 1:1 to 1:6 preferably 1:1.2 to 1:3 (Coal: solvent on a weight basis).

The heavy oil produced during the distillation in this system can be used to the solvent. The heavy oil can be used just as it is produced or it may be first subjected to hydrogenation. In accordance with this invention, coal is dispersed into the solvent in a slurry tank, the hydrocarbon solvent preferably having a boiling point of between 150° C. and 500° C. The coal-solvent dispersion is introduced into a reactor through a heater, and then the content of a reactor is heated to a temperature of between about 350° C. and 500° C. and subjected to a hydrogen pressure of greater than about 3 kg/cm$^2$G preferably 50 kg/cm$^2$G and 200 kg/cm$^2$G. The coal is thereby liquified by hydrogenolytic decomposition. After the dehydrogenation, the undissolved solid in the liquified solution is easily separated from the solution in a separating apparatus.

The liquified solution separated from the residues or the liquified solution unseparated from the residues is introduced into a distillation apparatus, and three separate fractions, namely a gaseous, a light-and a heavy-hydrocarbon fraction, are recovered. Solvent reformed coal having a low sulphur content is recovered as the bottom residue and then reformed coal with suitable properties is obtained.

Moreover, according to the present invention, organic sulphur, organic oxygen and organic nitrogen are removed by a conventional process because they change to $H_2S$, $H_2O$, $NH_3$ in this process, and mineral substances in the coal are removed as residues by conventional separation. Also, metallic substances such as V, Ni etc. in the solvent are absorbed by the insoluble residues and are removed from the products. Consequently, in spite of using coal, coal oil and petroleum oil, all of which have significant impurities, a reformed coal product with desirable properties is manufactured.

A part of gaseous hydrocarbon and light oil from distillating apparatus is introduced into a reforming apparatus as starting material for the production of hydrogen and the remainder is discharged. The hydrogen from reforming apparatus is used as all or part of the hydrogen for the hydrogenation reaction in the process of this invention. Heavy oil is returned to slurry tank as a recycled solvent.

In order to increase the coal conversion and the effect of desulfurization, a conventional catalyst may be used in some cases. Red mud (Residues from alumina manufacture. Component: $SiO_2$ of 13–15%(wt), $Al_2O_3$ of 20–23, $Fe_2O_3$ of 39–42, $TiO_2$ of 2.5–3.0, $Na_2O$ of 7–8, $H_2O$ of 10–12) or limonite is suitable as the catalyst. The period of heating to produce dissolution is determined as sufficient to produce a slurry which can be easily filtered. Preferably, the treating time is between about 10 and 120 minutes.

The soluble components of the coal are dissolved sufficiently in the solvent and the insoluble components are separated by filtration or by centrifugation, so that a solution of a de-ashed and a desulfurized coal is obtained. Such removal of the insoluble components, however, is not always required. The solution of coal is distilled at a temperature of from about 250° C.–450° C., the solvent is recovered and the recovered solvent is used as the recycle solvent in this reaction. The reformed coal which is recovered as the residue is liquid at elevated temperature, but at ordinary temperatures, it is solid and appears as pitch-like material.

The melting point of the reformed coal is variable as a function of the ratio of solvent recovered, and according to the present invention reformed coal with a melting point of less than 350° C. is manufactured. The reformed coal thus obtained is very useful for the sources of electrodes, binders, cokes and so on. The properties of the raw coal and of the reformed coal are described in the following table.

| | Raw Coal A | | Raw Coal B | |
|---|---|---|---|---|
| | Raw Coal | Reformed Coal | Raw Coal | Reformed Coal |
| Proximate analysis | | | | |
| Water content (%) | 3.0 | 0.1 | 9.1 | 0.2 |
| Ash (%) | 7.1 | 7.4 | 3.2 | 3.5 |
| Volatile matter (%) | 38.4 | 38.4 | 44.0 | 28.9 |
| Fixed carbon (%) | 51.5 | 51.5 | 43.7 | 70.6 |
| Button number | 1 | 3< | 1 | 8< |
| Gieseler fluidity (DDPM)* | 0 | 100,000 | 0 | 100,000 |
| Ultimate analysis (d.a.f)** | | | | |
| C (%) | 78.45 | 86.76 | 66.30 | 38.04 |
| H (%) | 5.20 | 5.34 | 4.97 | 5.09 |
| N (%) | 1.19 | 1.38 | 0.51 | 0.82 |
| S (%) | 3.75 | 1.98 | 1.62 | 0.53 |
| O (%) | 11.41 | 4.52 | 26.60 | 5.52 |
| H/C | 0.798 | 0.738 | 0.900 | 0.694 |
| O/C | 0.108 | 0.039 | 0.300 | 0.047 |
| Melting point (°C.) | — | 250 | — | 167 |
| B.I.*** (%) | — | 61.3 | — | 58.8 |
| Q.I. **** (%) | — | 7.9 | — | 4.0 |

*DDPM: Dial divition per minute (ASTM)
**d.a.f.: Dry ash free
***B.I.: Benzol Insoluble Matter
****Q.I.: Quinoline Insoluble Matter The table above illustrates the fact that reformed coal with coking capacity is made from non-coking coal. Since exhaustion is expected of supplies of coal suitable for producing metallurgical coke with high fluidity by Gieseler plastometer, the product produced by this invention is a most important material for use as coal suitable for producing metallurgical coke with high fluidity. From the foregoing table, the increase in carbon content and the decrease in oxygen content are clear, and thus the improvement of properties is recognized for the rank of coalification. In particular, when the raw-coal and the reformed coal are shown on the coal-band curve which shows the rank of coalification, it becomes clear that the improvement of rank occurs and that a sub-bitminous coal changes to a strongly coking coal. See the figure of drawing.

This reformed coal as well as normal coal suitable for producing metallurgical coke can be used, after crushing and blending, as the charging coal for the chamber coke oven. Since the reformed coal has a higher fluidity by Gieseler plastometer, a blended mixture produced from the reformed coal and a non-coking coal of a lower price can be used as the material to form excellent coke, and use of a large amount of coking coal of high price can be avoided. Moreover, this reformed coal may be used for manufacturing briquettes of coal, i.e., as the binder for briquetting of coal particles, and excellent coke can be manufactured from the mixture composed of charging coal and these briquettes in conventional chamber ovens. Excellent coke is manufactured from this hot briquette by calcining in the exclusive calciner.

In this invention, a blended coal which has about 2%–30% reformed coal based on the total composition, and preferably 10%–20% reformed coal, is used as the charging coal for the high strength coke, and metallurgical coke is produced therefrom. This may be accomplished by producing a green briquette with about 3%–15% reformed coal content, preferably 5%–10% reformed coal and this briquette is then coked as it is. Alternatively, a green briquette with about 3%–20% reformed coal content, preferably 5%–10% reformed coal can be made and then blended with the charging coal in the ratio between about 10:90 and 50:50, preferably between about 20:80 and 30:70 (green briquette:-charging coal). This blended material is then coked in a conventional oven. The coke produced by the above method has high strength.

Coal tar pitch, asphalt and petroleum distillation residue have been considered as a binder for coals. Because coal tar pitch generally has a lower melting point than that of reformed coal, the range of its application as a binder is limited. When all of the coal tar produced from a coke oven is treated, the yield of coal tar pitch is only 3%–4% of the yield of coke, and therefore, the shortage of coking coal which is expected in the future cannot be solved by using coal tar pitch.

Petroleum distillation residue has a high fluidity. But, since the residue thereof has lower aromaticity than that of reformed coal, the yield of coke is lower. In addition, because the residue thereof has a higher sulfur content, due to the condensation of sulfur in the raw oil, this represents a fatal weakness with respect to using this as a blending material for coal. If this residue is used for blending with coal, the effect is a lower production than that of reformed coal. On the other hand, since the structure of reformed coal resembles the chemical structure of coal, the melting and blending affinity of the coal particles with each other in the state of coking is good, i.e., the compatibility is good.

For the purpose of further illustrating the present invention, a description will now be given of illustrative, non-limiting examples.

EXAMPLE 1

In this example, semianthracite, weakly coking coal and coking coal are blended in advance, and reformed coal is then blended to the mixture. This final mixed coal is coked by the method of JIS* M8801 (can test) and coke with a higher strength is obtained.

*JIS M8801=Japanese industrial standard

Summary of JIS M8801 (Can Test)

The sample is put in an 18 l vessel and is coked in the bottom of a coke oven. The properties of the coke produced in the vessel are measured by a strength test and another quality test.

| | | |
|---|---|---|
| Mixed Coal | South African (Semianthracite) Natal coal | 30% |
| | Australian (weakly coking coal) Lemington coal | 50% |
| | Japan (Miike coal) caking coal | 20% |

The ratio of mixed coal to reformed coal and the strength of the coke.

| | | | |
|---|---|---|---|
| Mixed coal (%) | 100 | 90 | 80 |
| Reformed coal (%) | — | 10 | 20 |
| Strength of coke $DI_{15}^{30}$ | 50 | 88 | 92 |

DI = drum index

EXAMPLE 2

In this example, the coal which is suitable for preparing coke for iron manufacturing is replaced by reformed coal, i.e., one such coal is replaced in run A and one in run B, and coke with a higher strength, just as the usual coke, is obtained in each instance. The data is summarized in the following table.

Condition of coking is according to JIS M8801 (can test).

| | Conventional Coke | Coke Produced From the Mixed Coal. Contained Reformed Coal | |
|---|---|---|---|
| The ratio of the mixture (%) | | A | B |
| American low volatile bituminous coal | 12 | — | 12 |
| American middle volatile bituminous coal | 24 | 24 | 24 |
| Australian strongly coking coal | 19 | 19 | — |
| Australian semi strongly coking coal | 21 | 21 | 21 |
| Australian weakly coking coal | 14 | 14 | 14 |
| Japanese Miike coal caking coal | 10 | 10 | 10 |
| Reformed coal | | 12 | 19 |
| Strength of the coke $D_{15}^{30}$ | 92.1 | 92.5 | 92.7 |

EXAMPLE 3

Zero percent, 4%, 6% or 10% reformed coal is blended with "the charging coal" described below. The blended mixture is heated by steam with high pressure and briquetted by a roll-press, and a green briquette is obtained. "The charging coal" having this briquette formed is coked according to the method described in Example 1.

Coke with a higher strength is obtained from "the charging coal" when the green briquette containing reformed coal is blended with the coal having a lower strength. Dat is set forth for the blends defined in the table below.

The composition of "the charging coal" is as follows:

| | |
|---|---|
| American, strongly coking coal with lower V.M. | 10% |
| American, strongly coking coal with middle V.M. | 20% |
| Australian, strongly coking coal | 14% |
| Australian, semi strongly coking coal | 12% |
| Australian, weakly coking coal | 30% |
| Japanese Miike coal caking coal | 14% |

V.M. represents volatile matter.

The ratio of "the charging coal" and green briquette is as follows:

| | | | | | | | |
|---|---|---|---|---|---|---|---|
| Charging Coal | 100(%) | | 70(%) | | | 50(%) | |
| Green briquette | | | 30(%) | | | 50(%) | |
| Percentage of reformed coal in grean briquette | | 4% | 6% | 10% | 4% | 6% | 10% |
| Strength of coke $DI_{15}^{30}$ | 90 | 94.5 | 94.7 | 94.9 | 93.7 | 93.7 | 93.9 |

DI represents drum index.

EXAMPLE 4

Coal compositions for carbonization are prepared having the compositions described below, after which they are heated by the high pressure steam and then briquetted by a roll press. The green briquette produced is heated in a stand bath at a temperature of 950° C. for one hour. The coke produced has a higher strength. The blending ratios of coal and the strength of coke are as follows:

| | | | |
|---|---|---|---|
| Australia | Semi strongly coking coal | 50% | 45% |
| South Africa | Natal coal semi anthracite | 20% | 20% |
| Japan | Miike coal caking coal | 20% | 20% |
| | Reformed coal | 10% | 15% |
| | Strength of coke $DI_{15}^{30}$ | 94.0 | 94.5 |

What is claimed is:

1. A process for manufacturing a high-strength metallurgical coke, having a drum index ($DI_{15}^{30}$) of at least 92, comprising the steps of:

(a) dissolving at least one first coal component selected from the group consisting of bituminous coal, sub-bituminous coal, brown coal and lignite in a hydrocarbon solvent under hydrogenation conditions sufficient to depolymerize coal to produce a solution;

(b) distilling said solution and recovering a reformed coal as a distillation bottoms product;

(c) blending said reformed coal with a second coal component, which is a coal composition, comprising at least one high rank coal and which itself, upon carbonization, yields a high-strength metallurgical coke, having a drum index ($DI_{15}^{30}$) of at least 92; and (d) subjecting said blended coal to coking conditions at a temperature sufficient to produce high-strength coke.

2. The process for manufacturing coke as defined by claim 1, wherein said dissolving step comprises dissolving said component at a temperature of from about 300° C. to 500° C. and in the presence of hydrogen gas at a pressure greater than about 3 kg/cm$^2$ in a hydrocarbon solvent having a boiling point of higher than about 150° C.

3. The process as defined by claim 1, wherein only the blended coal made from said reformed coal and from at least one other coal is coked.

4. The process as defined by claim 3, wherein the blended coal made from said reformed coal and from at least one other coal is first hot briquetted and then the briquetted coal is coked.

5. The process as defined by claim 4, wherein the content of reformed coal in the hot briquetted coal is between about 3% and 15% by weight.

6. The process as defined by claim 4, wherein the content of reformed coal in the hot briquetted coal is between about 5% and 10% by weight.

7. The process as defined by claim 1, wherein the weight ratio of the reformed coal to the other coal is between about 2:98 and 30:70.

8. The process as defined by claim 1, wherein the weight ratio of the reformed coal to the other coal is between about 10:90 and 20:80.

9. The process as defined by claim 1, wherein said reformed coal has a melting point of less than about 350° C.

10. The process as defined in claim 1, wherein said distillation step comprises separating a solid residue from said solution and subjecting the residual solution to distillation conditions sufficient for distilling a heavy oil.

11. The process as defined in claim 1, wherein said distillation step comprises distilling said solution at a temperature of from about 250° C. to about 450° C.

12. A process for manufacturing a high-strength metallurgical coke, comprising the steps of:

(a) dissolving at least one component selected from the group consisting of bituminous coal, subbituminous coal, brown coal and lignite in a hydrocarbon solvent under hydrogenation conditions sufficient to depolymerize coal to produce a solution;

(b) distilling said solution and recovering a reformed coal as a distillation bottoms product;

(c) blending said reformed coal with at least one other coal which is suitable for the production of high-strength metallurgical coke by carbonization;

(d) briquetting said blended coal made from the reformed coal and the other coal;

(e) blending at least one additional coal suitable for carbonization with said briquetted coal; and (f) subjecting said blend of briquetted coal and other coal to coking conditions at a temperature sufficient to produce high-strength coke.

13. The process as defined by claim 12, wherein the content of reformed coal in the briquetted coal is between 3% and 20% by weight and the weight ratio of briquetted coal to the other coal is between about 10:90 and 50:50.

14. The process as defined by claim 12, wherein the content of reformed coal in the briquetted coal is between 5% and 10% by weight and the weight ratio of briquetted coal to the other coal is between 20:80 and 30:70.

15. A process for manufacturing a high-strength metallurgical coke, having a drum index ($DI_{15}^{30}$) of at least 92, comprising the steps of:

(a) dissolving at least one first coal component selected from the group consisting of bituminous coal, sub-bituminous coal, brown coal and lignite in a hydrocarbon solvent under hydrogenation conditions sufficient to depolymerize coal to produce a solution;

(b) distilling said solution and recovering a reformed coal as a distillation bottoms product;

(c) providing a second coal component which (1) comprises at least one highrank coal, and (2) upon carbonization, yields a high-strength metallurgical coke having a drum index ($DI_{15}^{30}$) of at least 92;

(d) substituting said reformed coal for at least a portion of said high-rank coal in said second coal component to produce a blended coal; and (e) subjecting said blended coal to coking conditions at a temperature sufficient to produce high-strength coke.

* * * * *